US005611182A

United States Patent [19]

Spude

[11] Patent Number: 5,611,182

[45] Date of Patent: Mar. 18, 1997

[54] WALL FORM SYSTEM AND APPARATUS

[76] Inventor: Gerald T. Spude, 6628 Westslope La., Oconto, Wis. 54153

[21] Appl. No.: 252,918

[22] Filed: Jun. 2, 1994

[51] Int. Cl.[6] ..... E04B 2/86

[52] U.S. Cl. ..... 52/426; 52/274; 52/442; 52/562; 52/694

[58] Field of Search ..... 52/690, 693, 481.2, 52/562, 566, 567, 241, 425, 426, 442, 427, 438, 274, 293.3, 379, 694, 695, 696, 729.1, 729.2; 249/34, 38, 44, 45, 47, 216, 218

[56] References Cited

U.S. PATENT DOCUMENTS

| | | | |
|---|---|---|---|
| 1,244,870 | 10/1917 | Levens | 52/696 |
| 3,293,813 | 12/1966 | Emmons et al. | 52/481.2 |
| 3,772,842 | 11/1973 | Barbera | 52/562 |
| 4,678,156 | 7/1987 | Scalamandre et al. | 249/334 |
| 5,065,561 | 11/1991 | Mason | 52/426 |

FOREIGN PATENT DOCUMENTS

| | | | |
|---|---|---|---|
| 483097 | 5/1917 | France | 249/218 |
| 544943 | 5/1942 | United Kingdom | 52/694 |

*Primary Examiner*—Michael Safavi

*Attorney, Agent, or Firm*—Reinhart, Boerner, Van Deuren, Norris & Rieselbach, S.C.

[57] ABSTRACT

A system and apparatus for forming a wall on a footing. U-shaped and H-shaped channels coupled at their sides by rigid links hold foam panels in a desired spaced relationship. The channels and panels are stacked to a desired height, and concrete is poured between the channels and panels where it hardens to form a structural wall. The planar surfaces of the U-shaped and H-shaped channels enable the channels to be extruded, thereby substantially reducing channel production costs. Furthermore, widely available conventional foam panels are used, reducing panel production costs.

13 Claims, 14 Drawing Sheets

WALL FORM SYSTEM AND APPARATUS

BACKGROUND OF THE INVENTION

This invention relates generally to building construction systems and, more particularly, to building construction systems for forming walls, especially foundation walls and the like.

Concrete foundation walls have typically been constructed using expensive and reusable forms. These forms have typically been heavy and extremely labor-intensive to assemble. To reduce construction expense, various other form systems for walls have been proposed. These systems typically reduce labor costs and expense through the use of light and inexpensive materials that can be left in place after concrete or other building materials are poured into the form system.

Although effective, these alternate systems are not without drawbacks. Typically, these designs have required parts that are formed by injection molding, which is an expensive process requiring expensive tooling. This injection molding limitation also has limited the practical length of the parts that can be produced to around nine feet long. These relatively short lengths increase labor costs by increasing the number of connections required in the assembly process.

Previous designs have generally required complex shapes and have required relatively complex assembly procedures. This complexity has increased training costs and has decreased efficiency as workers learned to use the system. Further, this complexity has increased tooling costs.

Futhermore, leveling the top of the form has been difficult and labor-intensive with previous designs. It is critical to have a level foundation upon which to build, yet prior artdesigns have generally not provided a convenient way of achieving a level configuration.

Another important design criterion concerns connection to abutting pieces and the ability to form corners without requiring complex pieces produced by labor-intensive operations. Previous designs have necessitated the use of special pieces which increase tooling costs and increase the complexity of the design. Further, appropriate inventories of each of the pieces had to be accurately established to avoid costly delays midway through the project as more pieces of a certain type were purchased and transported to the job site.

In view of the foregoing, it is a general object of the present invention to provide a new and improved wall form system and apparatus.

It is a further object of the present invention to provide a new and improved wall form system and apparatus that provides attachment surfaces to which drywall can be coupled to meet existing building code requirements.

It is a further object of the invention to provide a wall form system that is easy to use and that reduces training costs by eliminating the numerous special use pieces required by many previous designs.

SUMMARY OF THE INVENTION

The invention provides a wall form system and apparatus including H-shaped and U-shaped lengths of extruded plastic or steel coupled at their sides by rigid links. The links are coupled at ninety degree angles along the lengths of the H-shaped and U-shaped elongated members. Wall panels, such as polystyrene boards, are received in channels in the H-shaped and U-shaped lengths to retain the wall panels in a spaced-apart relationship. This spacing enables flow of hardenable liquid building material (e.g., concrete) between the wall panels and the H-shaped and U-shaped elongated members.

The H-shaped and U-shaped lengths also enable coupling of drywall and other building materials to the assembly formed by the H-shaped and U-shaped elongated members, the links, the wall panels and the hardened building material. The wall panels and H-shaped lengths can be stacked upon each other to create a wall form of desired height. The links prevent compression or expansion of the wall form system so that the resulting wall is of the desired dimension.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
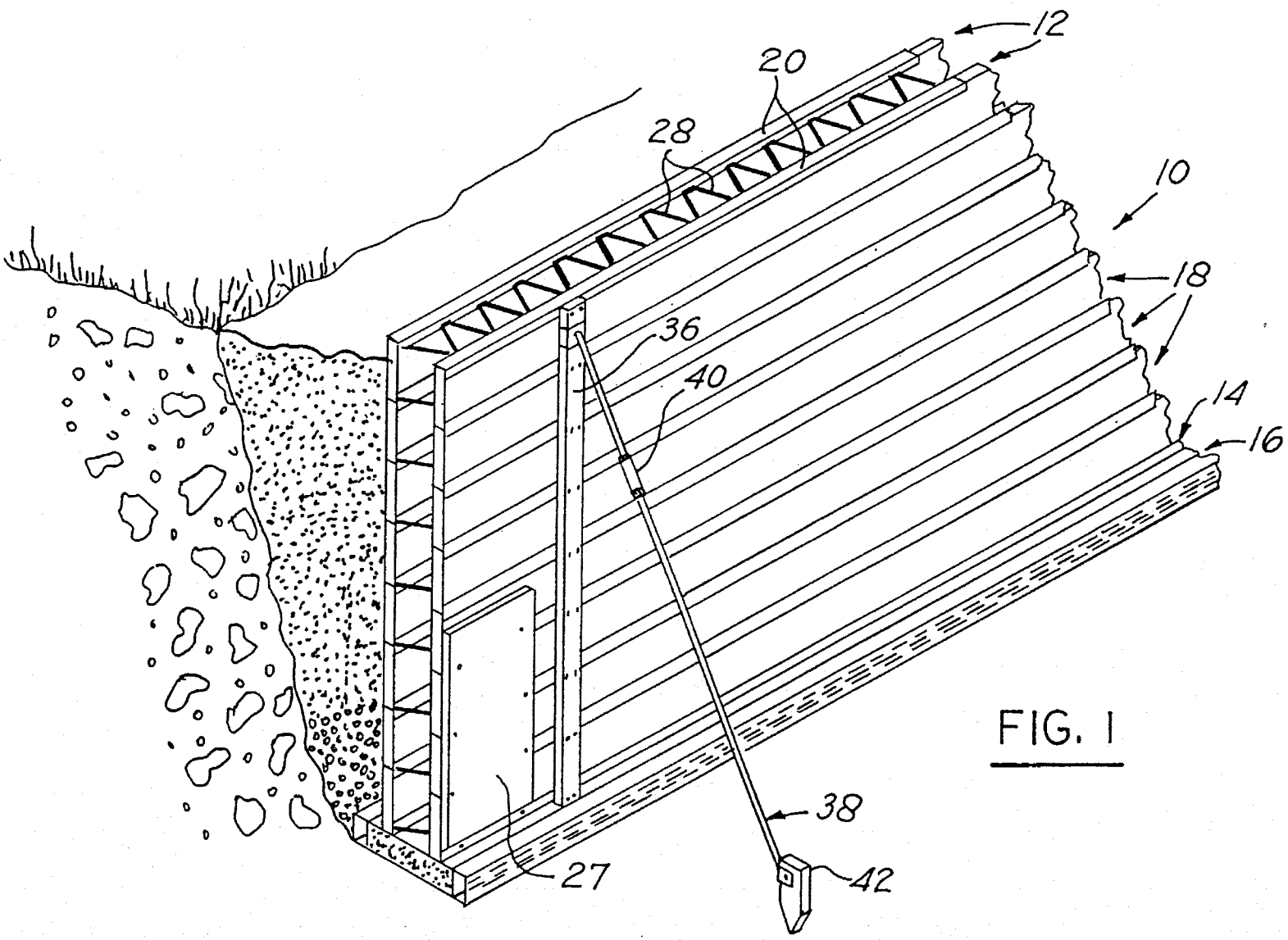
FIG. 1 is a perspective view of a wall form system and apparatus constructed in accordance with one form of the invention.
Figure 2:
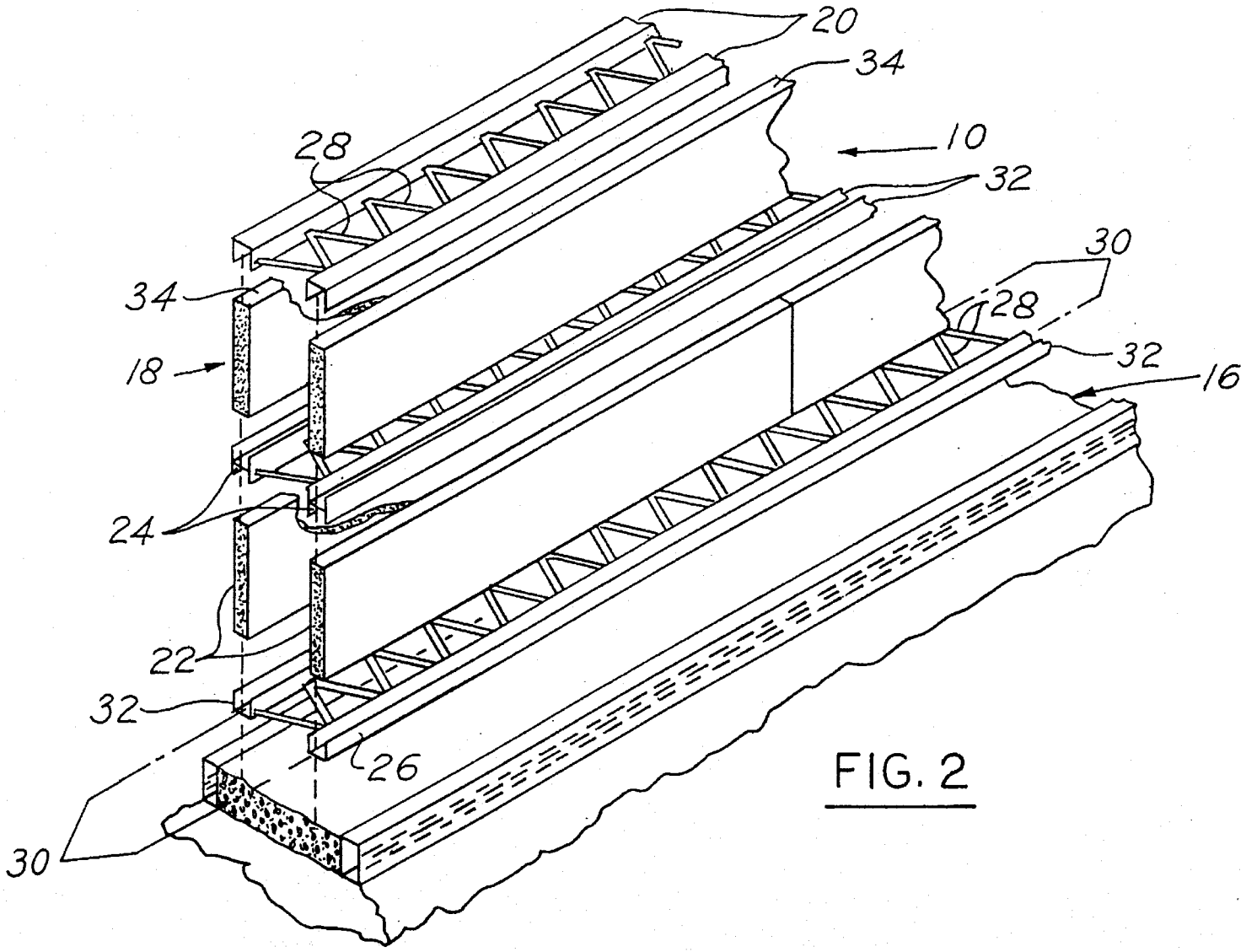
FIG. 2 is an exploded perspective view of the wall form system and apparatus shown in FIG. 1.

Referring to the drawings, a wall form system and apparatus is shown in FIG. 1. The wall form system and apparatus is useful in construction and provides a form or mold for retaining concrete or other similar building materials until they harden to form a structural wall. The wall form system 10 provides two spaced parallel walls 12 between which concrete can be poured to form a structural wall. In the illustrated embodiment, the wall form system 10 comprises a bottom assembly 14 set on a footing 16, a plurality of wall assemblies 18 stacked thereon, and a top cap 20 placed on the top of a stack of the wall assemblies 18 as shown in FIGS. 1 and 2. The wall assemblies 18 preferably include wall panels 22 formed of a rigid, lightweight, inexpensive material such as expanded or extruded polymer foam inserted into H-shaped elongated members 24 that allow stacking of the wall panels 22. The wall panels 22 and the components they are inserted in have substantially planar surfaces. This enables widely available polymer foam materials to be used for the wall panels 22. Furthermore, the components can be easily and inexpensively extruded due to this planar design.

Figure 3A:
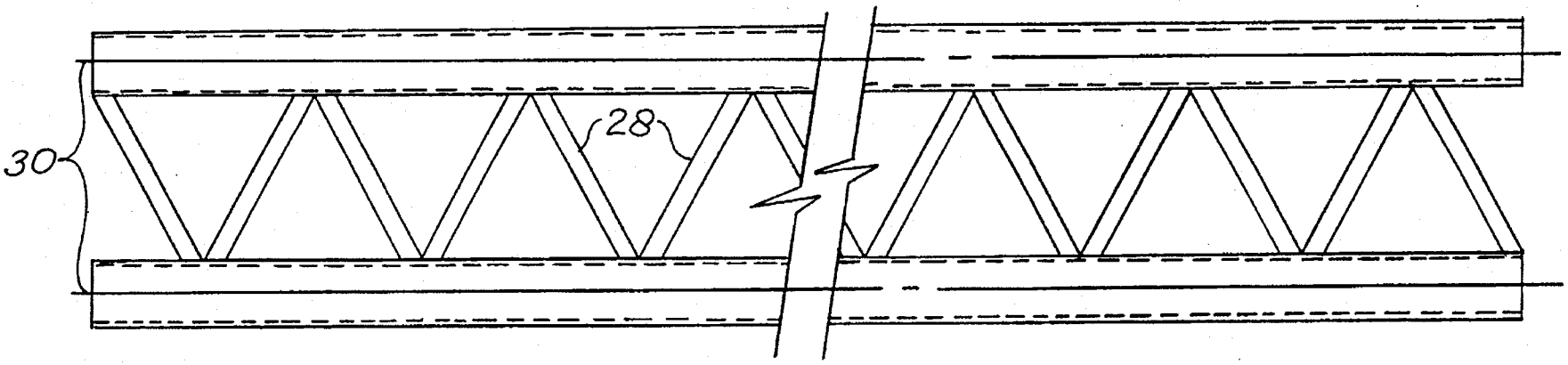
FIG. 3A is a bottom view of U-shaped bottom members connected by links.
Figure 3B:
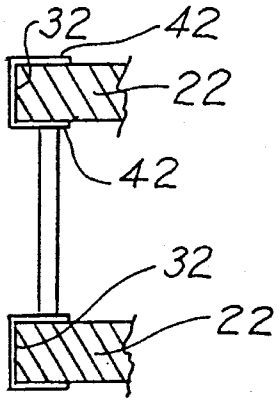
FIG. 3B is an end view of the members and links shown in FIG. 3A.
Figure 4A:
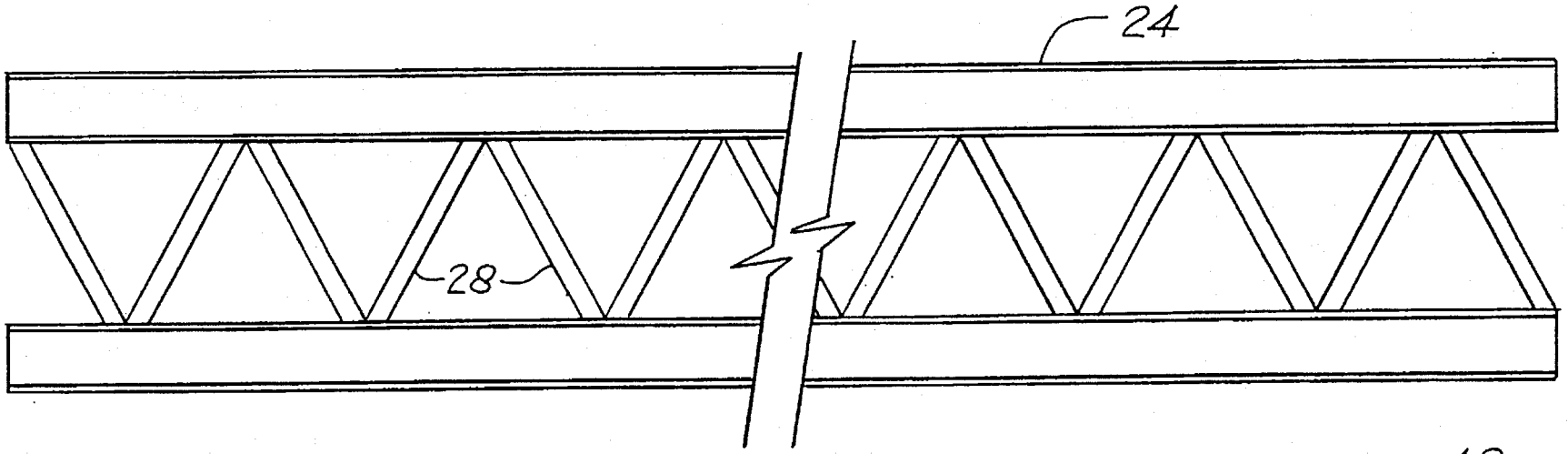
FIG. 4A is a top view of H-shaped members connected by links at acute angles.
Figure 4B:
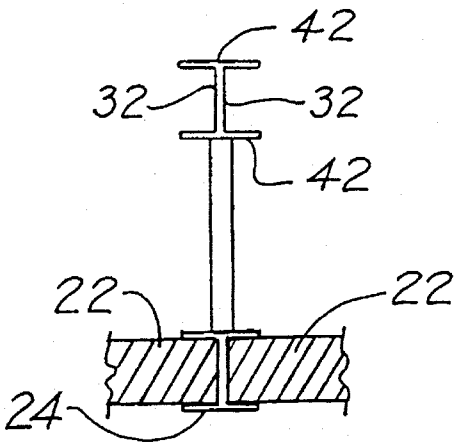
FIG. 4B is an end view of the members and links shown in FIG. 4A.
Figure 4C:
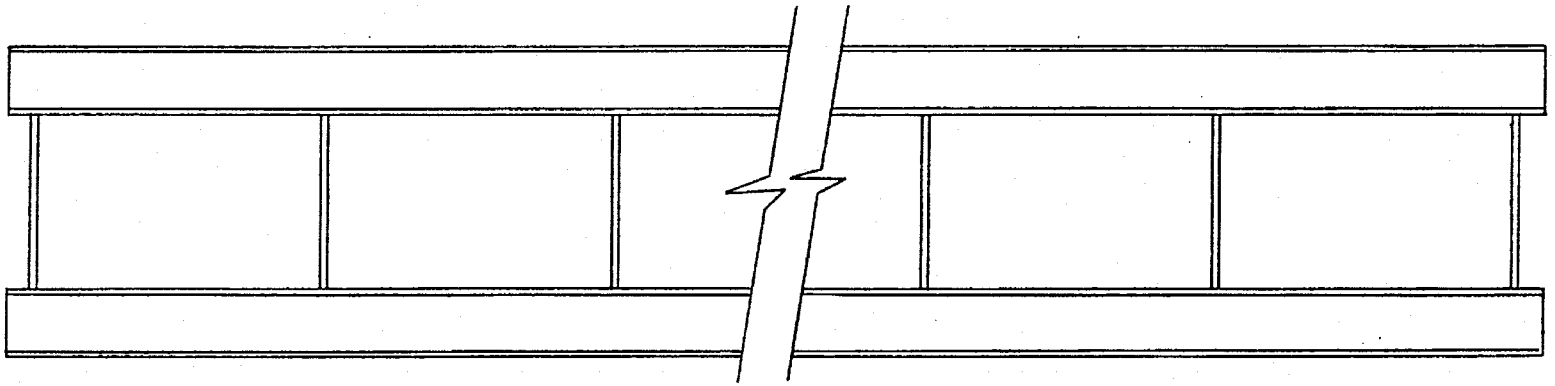
FIG. 4C is a top view of H-shaped members connected by links at ninety degree angles in accordance with the most preferred embodiment of the invention.
Figure 4D:
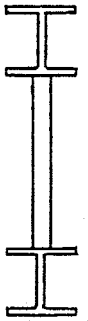
FIG. 4D is an end view of the members and links shown in FIG. 4C.

The bottom assembly 14 comprises two substantially U-shaped elongated members 26 connected by rigid links 28, as shown in FIGS. 2, 3A and 3B. In the most preferred embodiments, the top cap 20 is identical to the U-shaped elongated members 26. The links 28 are illustrated connected at acute angles along longitudinal axes 30 of the substantially U-shaped elongated members 26 as shown in FIG. 3A. However, the links 28 can be connected to the U-shaped elongated members 26, the H-shaped elongated members 24 (e.g. FIG. 4C) and top cap 29 at ninety degree angles which is the most highly preferred embodiment. The links 28 retain the wall panels 22 in a spaced-apart relationship to allow flow of the hardenable liquid building material (e.g. concrete) between the wall panels 22 and the U-shaped elongated members 26. Further, connecting the links 28 at ninety degree or acute angles prevents longitudinal shifting as well as compression or expansion of the spaced-apart relationship of the wall panels 22. This ensures the dimensional integrity of the resulting wall.

The wall panels 22 are received into the throats 32 of the U-shaped elongated members 26 as shown in FIG. 1, 2 and 3B. While various dimensions can be used, it has been found that a depth of 1.5 inches and a width of 2.5 inches for the U-shaped elongated members 26 works satisfactorily. An exemplary spacing between the U-shaped elongated members 26 is 7.62 inches.

After the wall panels 22 are placed into the throats 32 of the U-shaped elongated members 26 coupled by the links 28, a substantially H-shaped elongated member 24 is placed on top of each of the wall panels 22 as shown in FIGS. 1, 2, 4A, 4B, 4C and 4D. Next, wall panels 22 are placed into the throats 32 of the H-shaped elongated members 24. It will be recognized that slots can be cut into the wall panels 22 into which portions (such as the flanges 42) of the H-shaped elongated members 24 and U-shaped elongated members 26 can be inserted. However, this can increase labor costs (or production costs if the slots are cut at the factory). Stacking of the H-shaped elongated members 24 and the wall panels 22 can be repeated until a desired wall height is achieved as shown in FIG. 2. Further, the wall panels 22 can be easily cut to provide virtually any structural wall height desired. This is a distinct advantage over prior art systems which have typically required labor intensive operations to produce nonstandard structural wall heights.

Figure 5:
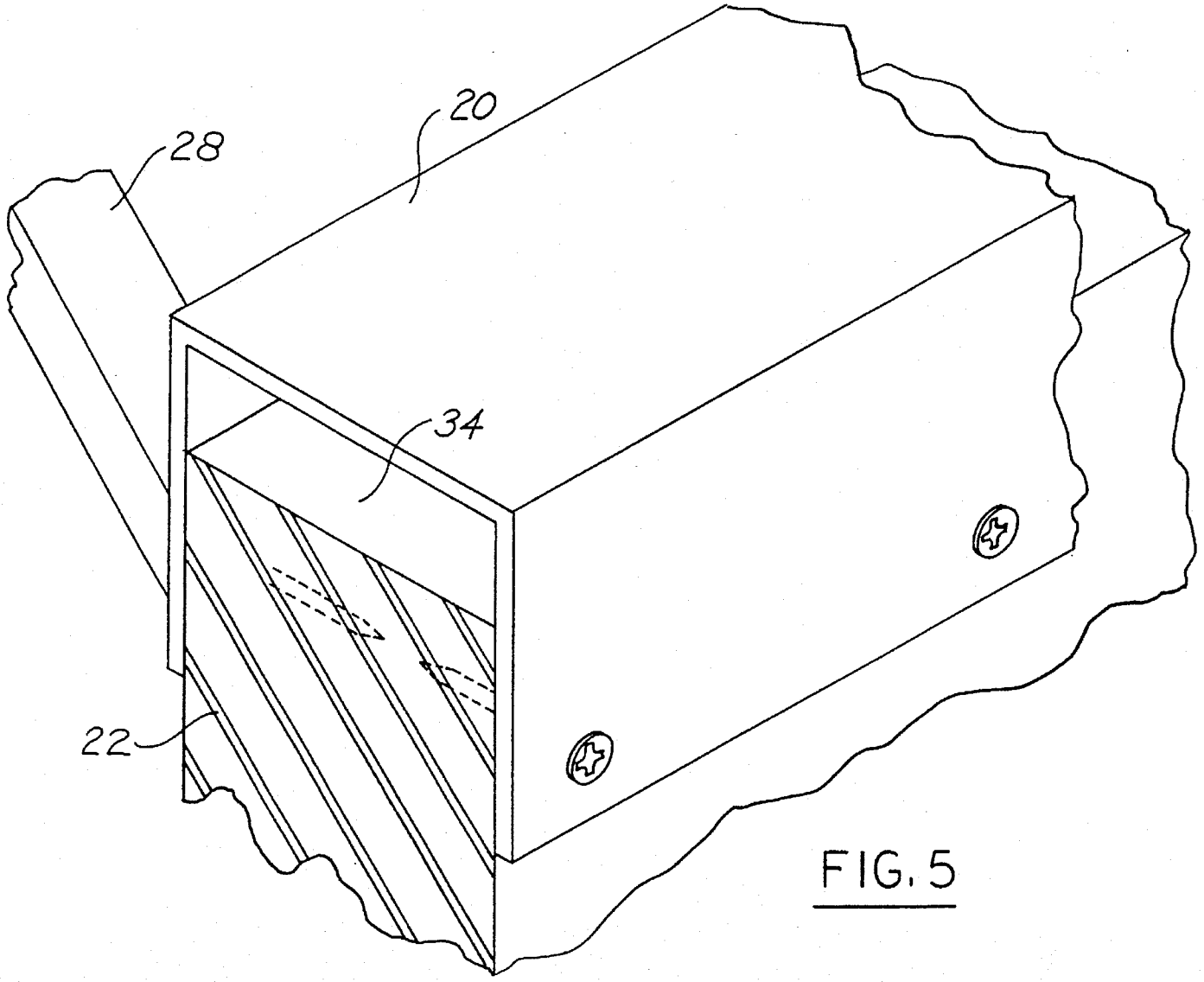
FIG. 5 is a perspective view of a top cap used to level the top of a wall panel.

A top cap 20 is placed over the upper edge 34 of the uppermost wall panel 22 as shown in FIGS. 2 and 5. If the upper edge 34 is not level, the top cap 20 can be fixed in place using drywall screws or other conventional means once it has been pivoted into a level configuration. In this way, the top surface of the resulting wall can quickly be made perfectly level, without requiring a complicated and labor-intensive process.

As shown in FIG. 1, the stacked wall assemblies 18 are braced on one side by a channel 36 connected to the wall assemblies 18 through use of drywall screws or other conventional means. The channel 36 is maintained in a desired configuration using a threaded steel rod mechanism 38 having a turnbuckle 40 disposed at its center. One end of the steel rod mechanism 38 is attached to the channel 36 and the other end of the steel rod mechanism 38 is connected to a post 42 driven into the ground. The wall assemblies 18 can be aligned at ninety degrees (plumb to the footing 16) by adjusting the post 42 and steel rod mechanism 38 accordingly.

Because the stacked wall assemblies 18 require bracing only on one side, workers never have to go outside the sections to work on the wall assemblies 18. This enables substantial reduction of the conventional four foot working space which is typically dug outside foundation walls. With the present invention, this clearance space can be reduced to one foot or even less. Accordingly, much less backfilling is required. Ideally, backfilling is accomplished using sand so that drainage around the foundation is enhanced. However, using conventional systems requiring the four foot working space, contractors often are reluctant to fill this entire space with sand due to the costs of such large quantities of sand. The substantially reduced backfilling far required by the present invention makes use of sand for backfilling far more cost effective.

The wall assemblies 18 are strong enough to allow the desired sand backfilling operations of the present invention to take place before concrete or other hardenable liquid building materials are poured into the system 10. This unusual strength enables greater flexibility in scheduling the backfilling operation, thereby expediting the construction process and lowering costs. Once all sections have been assembled and the top caps 20 have been leveled, hardenable liquid building material (preferably concrete) can be poured into the spaces between the top caps 20, wall panels 22, H-shaped elongated members 24 and the U-shaped elongated members 26. After the concrete hardens, a solid structural wall is formed. The invention allows drywall 27 or other building material to be connected to the wall assemblies 18 using drywall screws or other conventional means penetrating the flanges 42 of the H-shaped elongated members 24, U-shaped elongated members 26, as shown in FIG. 1. The drywall 27 can also be connected to the top cap 20 in an identical fashion.

While the members described herein, can be formed from a variety of materials such as steel and plastic, preferably steel or extruded plastic are used depending on the availability and material cost of each in a specific region. The extruded plastic design allows relatively long members to be formed without expensive tooling required for injection molded designs. Even with these longer members, it may still be desirable to splice sections of assembled wall assemblies together as shown in FIGS. 6A–6C and 7.

Figure 6A:
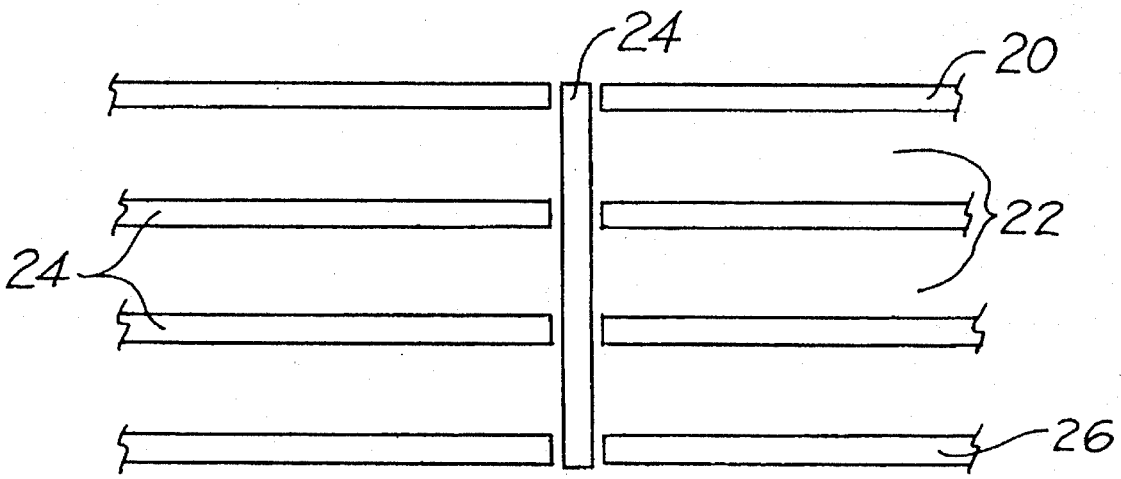
FIG. 6A is a side view of a wall section splice.
Figure 6B:
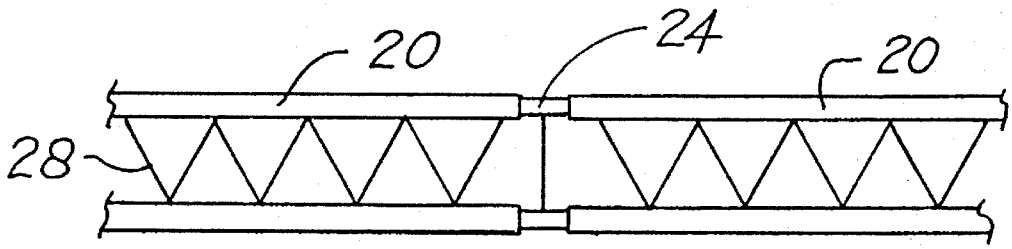
FIG. 6B is a top view of the splice shown in FIG. 6A.
Figure 6C:
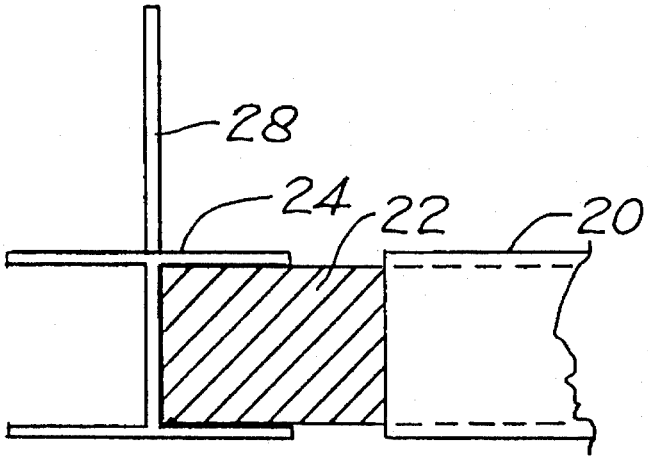
FIG. 6C is an enlarged sectional view of the splice shown in FIG. 6B.
Figure 7:
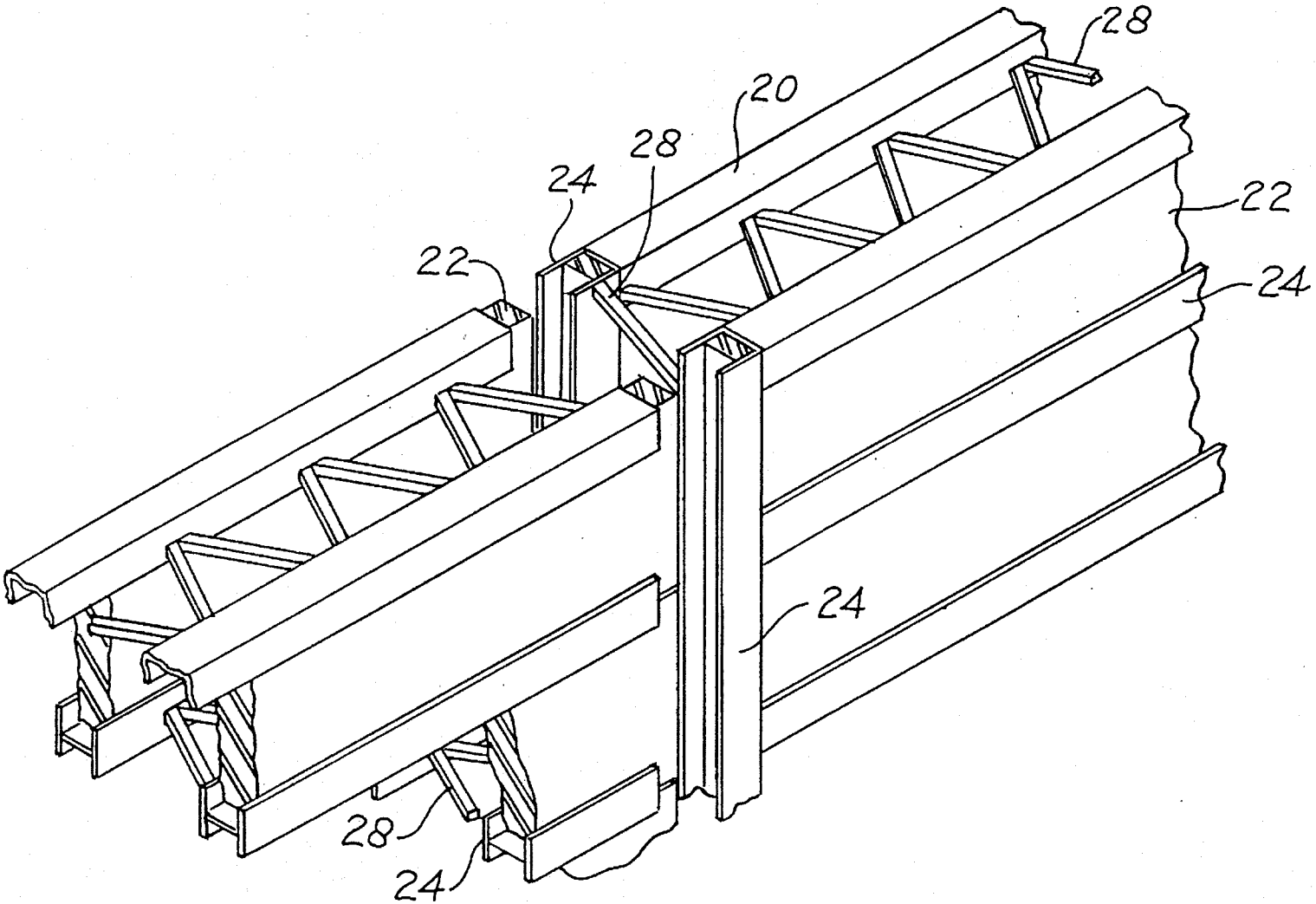
FIG. 7 is an enlarged and exploded perspective view of the splice (of two sections of assembled wall assemblies) shown in FIG. 6B.

The present invention does not require special, complex pieces for the splicing operation. Instead, an H-shaped elongated member 24 is placed vertically and abuts the H-shaped elongated members 24, the wall panels 22 and the U-shaped elongated members 26 from each section to be joined. The vertical H-shaped elongated member is connected to the various members using conventional means such as drywall screws. Next, the top cap 20 is placed over the assembled sections as shown in FIGS. 6C and 7. In this way, a secure connection is easily and quickly obtained.

Figure 8:
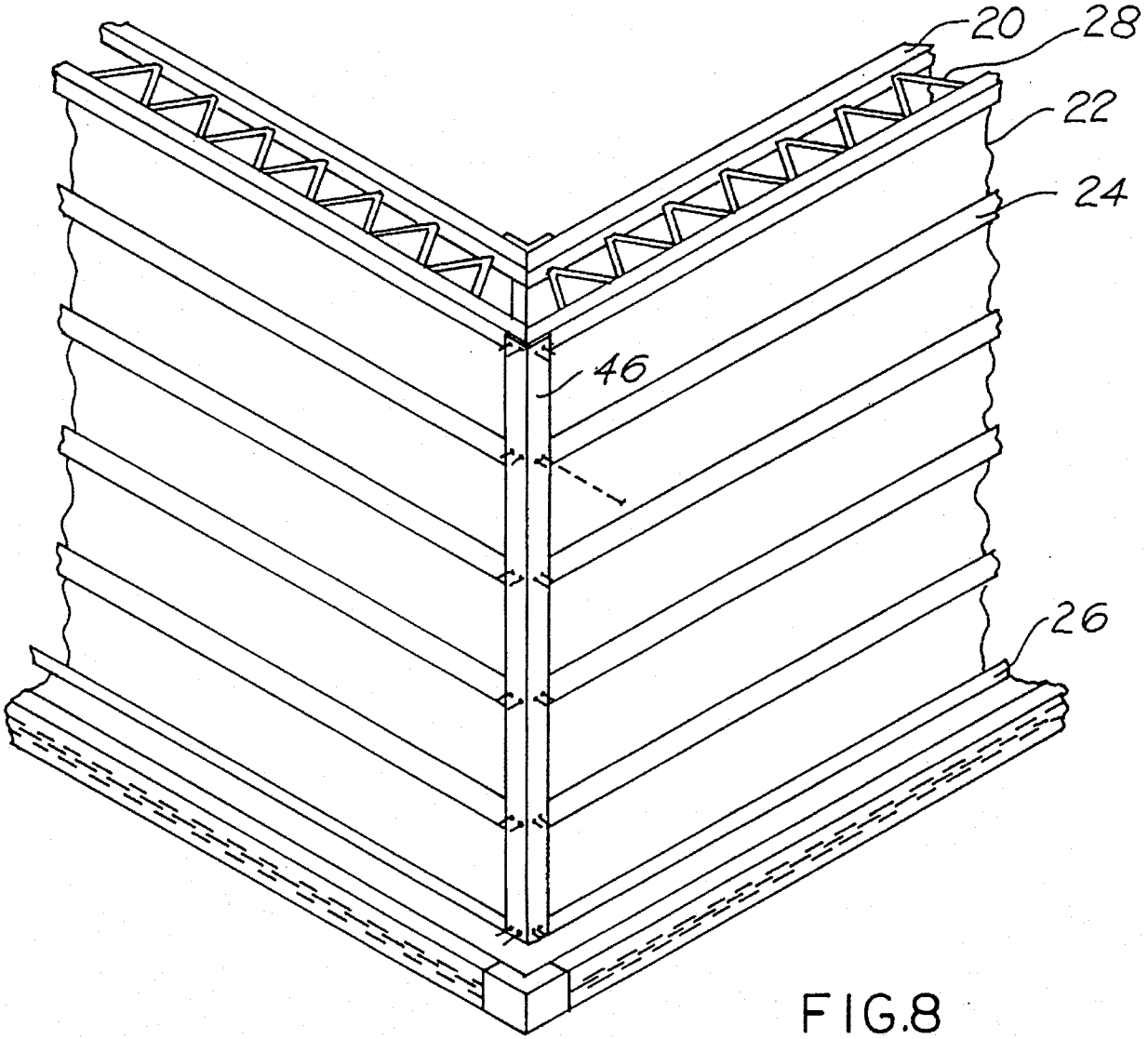
FIG. 8 is a perspective view of a ninety degree outside corner formed using one form of the present invention.

FIG. 8 shows a method of constructing a ninety degree outside corner. As illustrated, stacked assemblies are connected using two ninety degree angle pieces 46 connected to top caps 20, wall panels 22, H-shaped elongated members 24 and U-shaped elongated members 26 cut at forty-five degree angles. The angle pieces 46 are connected to the various members using conventional means such as drywall screws as shown in FIG. 8.

Figure 9:
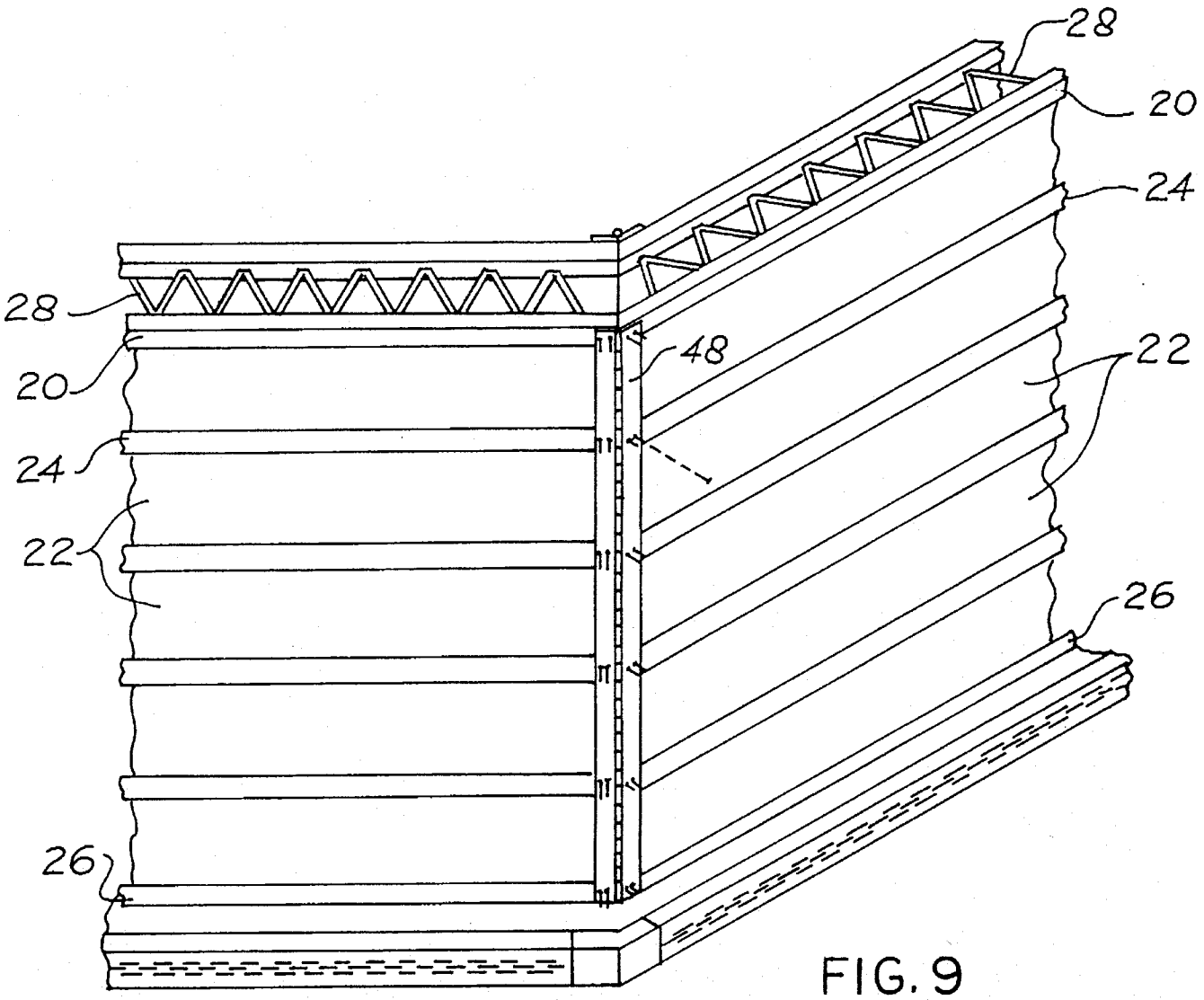
FIG. 9 is a perspective view of a forty-five degree outside corner formed using one form of the present invention.

FIG. 9 illustrates a forty-five degree outside corner constructed using one form of the present invention. In this case, the sections are cut at a twenty-two and one-half degree angle, and piano-hinge members 48 are coupled to the sections to retain them in place.

Figure 10:
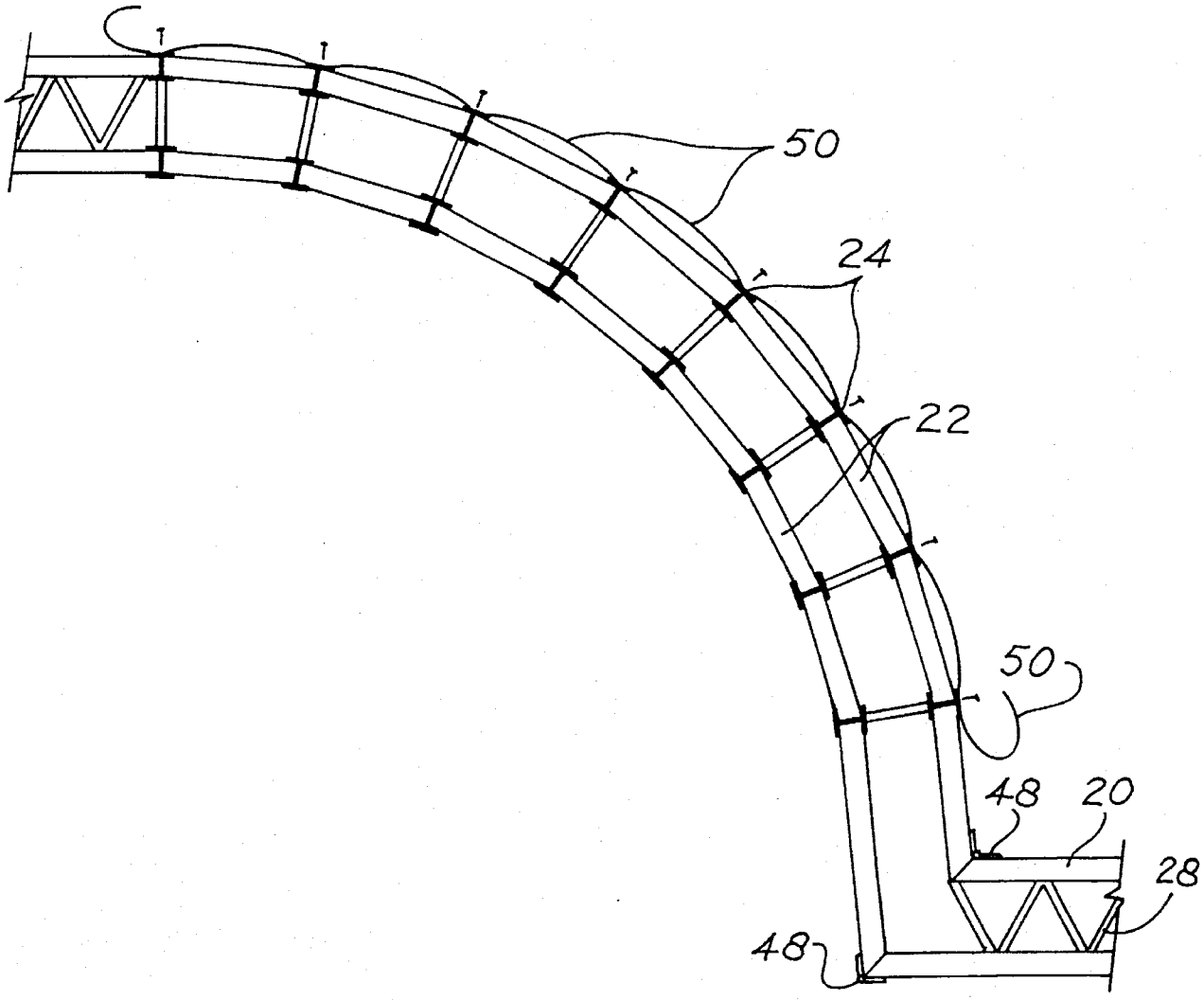
FIG. 10 is a top view of a wall form system for producing a curved wall.

The invention can also be used to form curved walls as shown in FIG. 10. In this embodiment, the beginning of the curved wall is connected to a standard section using piano hinge members 48 connected using conventional means such as drywall screws to a section abutting the curved section. The curved section comprises substantially H-shaped elongated members 24 in vertical orientation, similar to the splicing method described hereinbefore, along with narrower wall panels 22 for the inner portion of the curve section and wider wall panels 22 for the outer section. The entire assembly can be held together using conventional perforated metal strapping 50 or other conventional retention means as shown in FIG. 10.

Figure 11:
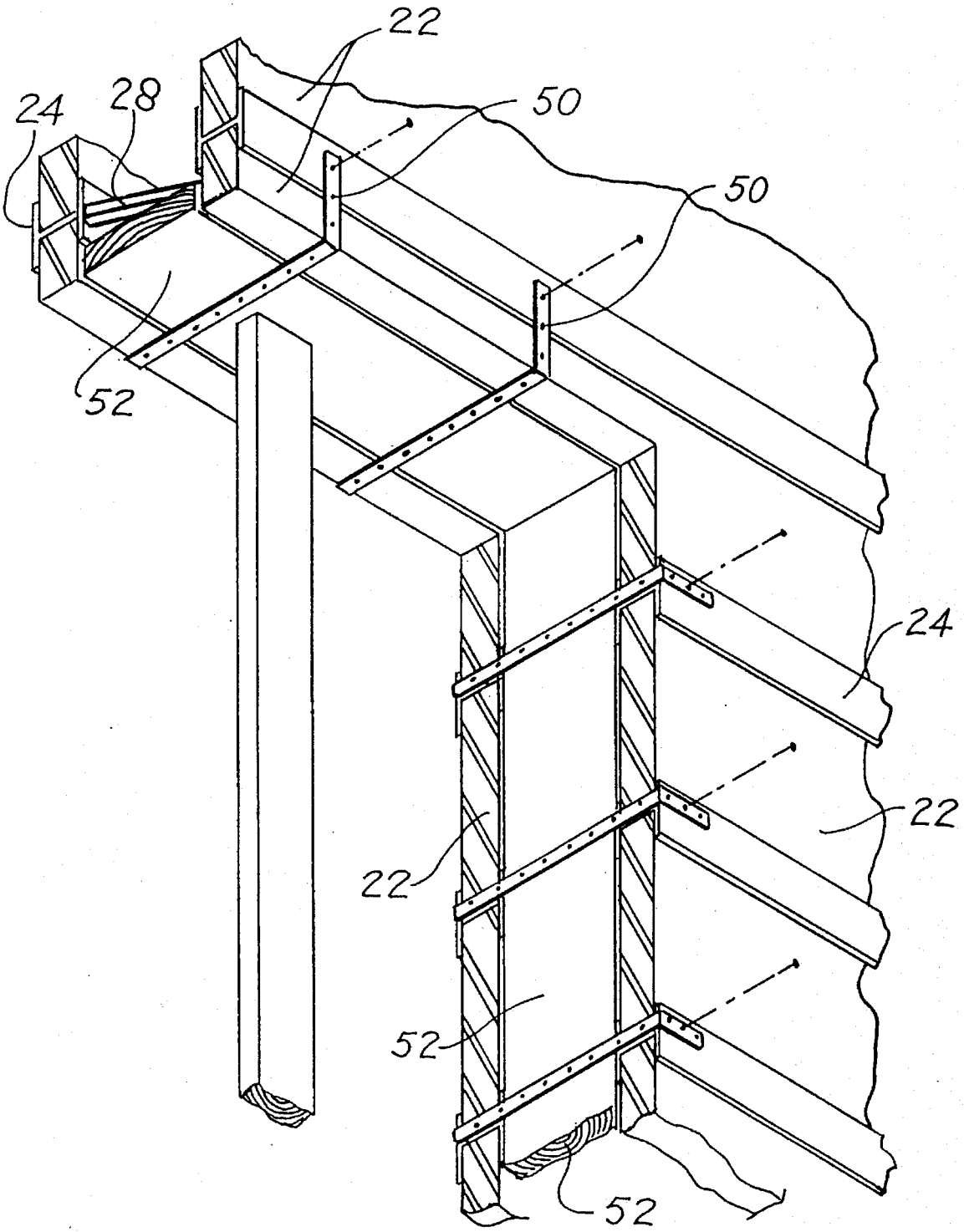
FIG. 11 is a perspective view of one form of the invention useful for framing a door or window opening.
Figure 12:
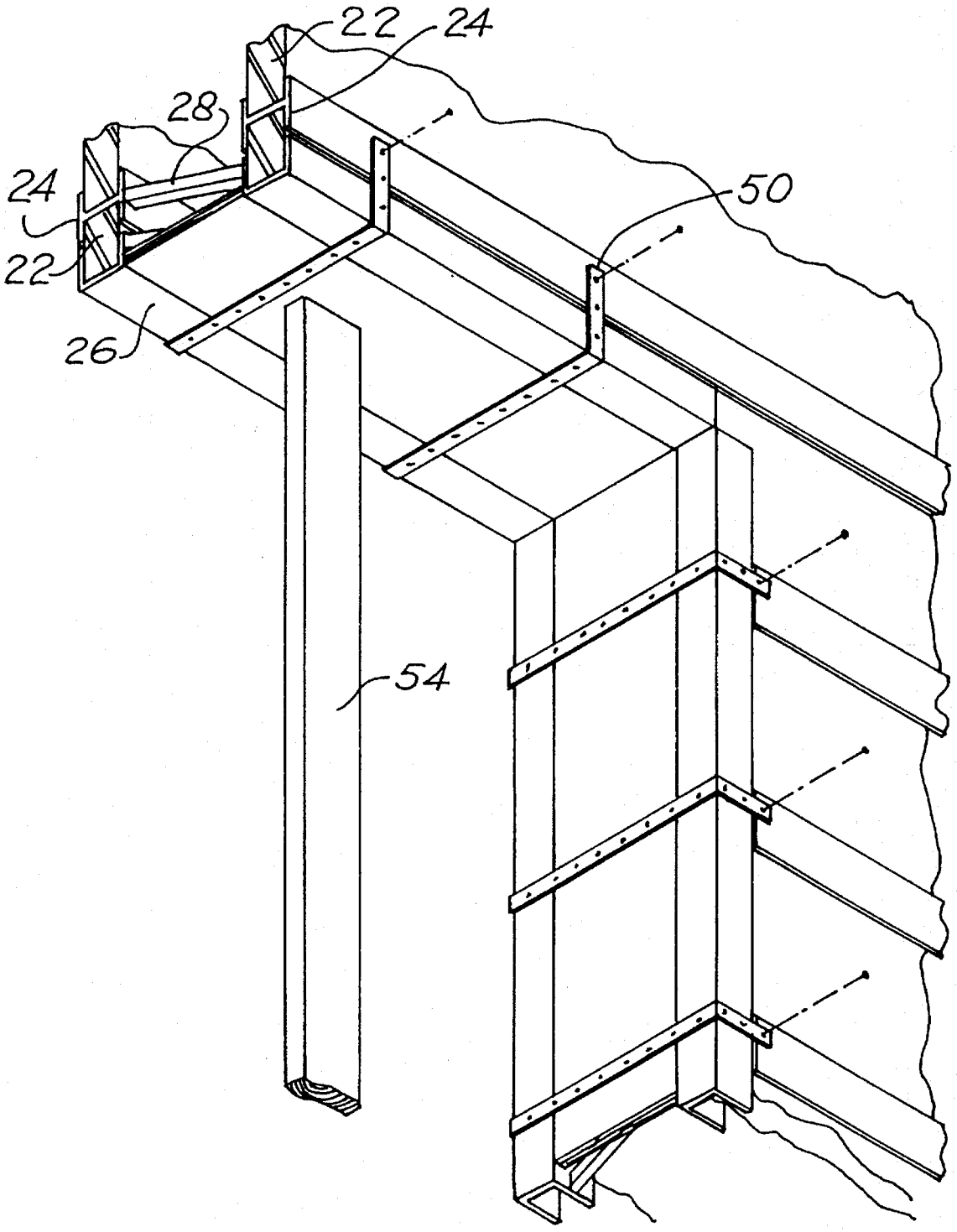
FIG. 12 is a perspective view of an alternative embodiment of one form of the invention useful for framing a door or window opening.
Figure 13:
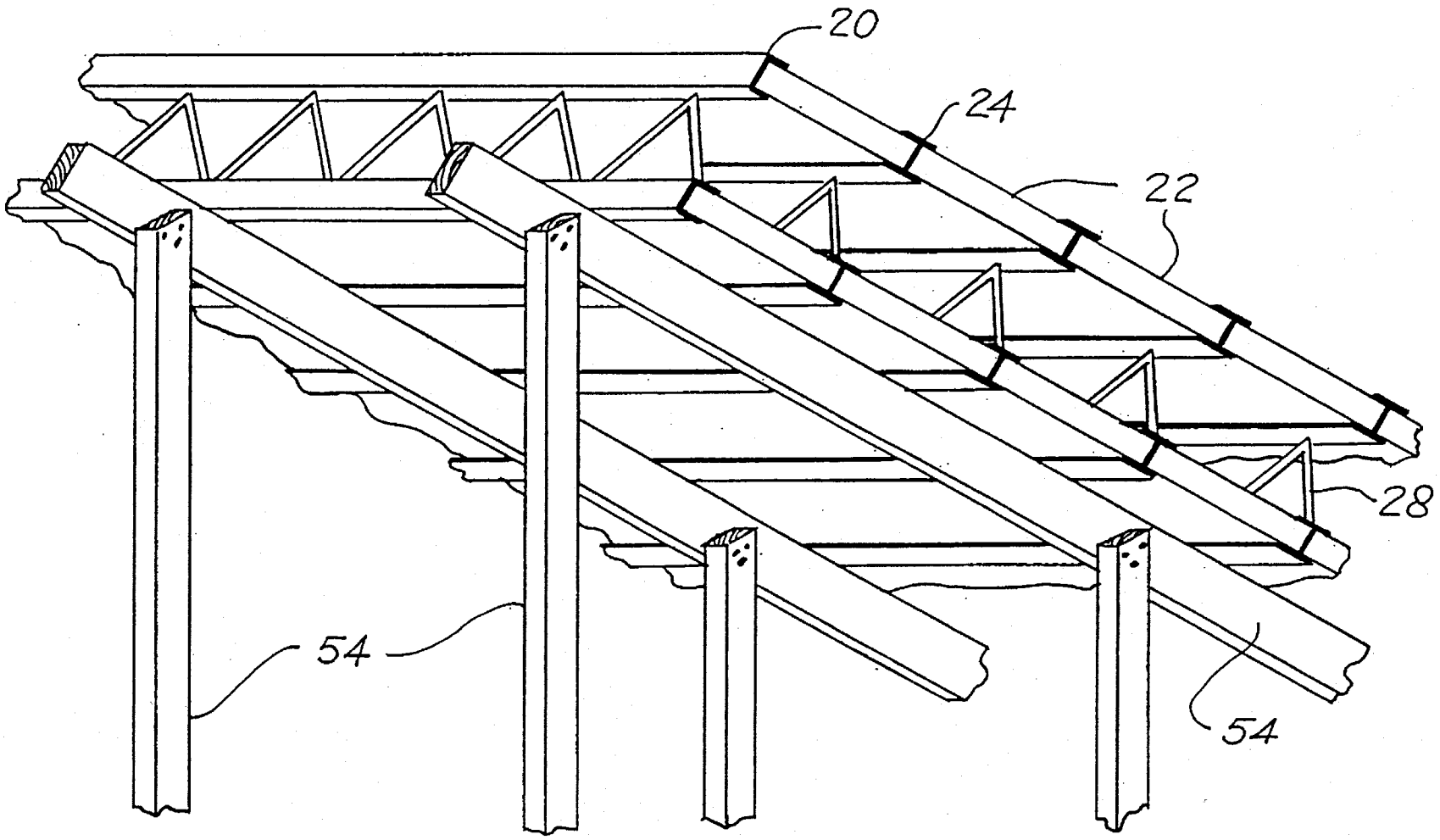
FIG. 13 is an end view of a roof application of one form of the invention.

FIGS. 11–13 show alternative embodiments of the invention, wherein lumber 52 can be held in place by conventional metal perforated strapping 50 to form an end seal, or top or bottom seal for various sections as described hereinbefore. FIG. 13 illustrates how the wall form system 10 can be braced for forming sections other than those that are strictly vertical merely by using sufficient bracing 54 to hold the system in place. In this way, an entire building structure can be produced using the present invention.

Accordingly, the present invention provides the ability to anchor drywall to the resulting wall. This is required by building codes in many areas of the country. Previous systems have typically not provided for this criterion, typically necessitating the use of masonry anchors which are expensive and time-consuming to install. The system of the present invention is simple to use, thereby reducing training costs and enhancing efficiency. Further, a smooth flat surface at the top of the form enables quick and easy clean up of concrete which spills over the side while pouring from conventional supply means such as a concrete truck. Because this spill over is very common, substantial labor savings can be realized by providing the easy to clean top surface of the present invention.

The invention provides a wall form system and apparatus that allows the upper surface of the wall to be adjusted to level without complex and/or labor-intensive operations. The present invention also provides a wall form system and apparatus that utilizes simple corner components that are strong and easy to install, and that requires no special pieces for connecting abutting pieces of the system to one another.

Further, the present invention provides the ability to level the top of a foundation wall, without requiring special pieces or cutting to attain a level upper surface of the wall. It also provides a fully adjustable wall form system and apparatus that can be produced by extruding to increase the length of the components that can be produced over previous injection molded designs and reduces tooling and labor costs accordingly. Finally, the inventors have discovered that a wall form system and apparatus can be designed to be strong enough to allow back filling operations to take place before concrete or other hardenable liquid building material is poured into the form. This enables easier access to the form for filling, and allows the back filling operation to be scheduled when time and weather permits. This flexibility of operation can further expedite the building process.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A wall system for forming a wall on a footing, comprising:

a plurality of U-shaped elongated members coupled at sides of said U-shaped elongated members by integral substantially rigid links;

a plurality of substantially parallel elongated and planar wall panels laterally spaced by insertion of bottom edges of said wall panels into said U-shaped elongated members;

upper edges of said wall panels inserted into bottom portions of a plurality of H-shaped elongated members coupled at sides of said H-shaped elongated members by integral substantially rigid links;

additional wall panels having bottom edges inserted into top portions of said plurality of H-shaped elongated members; and upper edges of said additional wall panels inserted into top cap members comprising inverted substantially U-shaped elongated structures extending along substantially the entire length of said wall panels, said top cap members being coupled by integral substantially rigid links, said links leaving sufficient open space between said top cap members to allow liquid building material for the wall to be poured between said top cap members.

2. The system as defined in claim 1, wherein additional said H-shaped elongated members and said wall panels are stacked to form a wall of desired height.

3. The system as defined in claim 1, wherein said H-shaped elongated members comprise plastic material.

4. The system as defined in claim 1, wherein concrete is poured between said top cap members, said parallel wall panels, said H-shaped members and said U-shaped members.

5. The system as defined in claim 1, wherein said H-shaped elongated members comprise extruded plastic material.

6. The system as defined in claim 1, wherein said H-shaped elongated members comprise steel.

7. The system as defined in claim 1, wherein said links prevent compression or expansion of the substantially parallel relationship of said wall panels.

8. A wall system for forming a wall on a footing, comprising:

a plurality of U-shaped elongated members connected at sides of said U-shaped elongated members by integrally formed substantially rigid links;

a plurality of substantially parallel elongated and planar wall panels laterally spaced by insertion of bottom edges of said wall panels into said U-shaped elongated members;

upper edges of said wall panels inserted into bottom portions of a plurality of H-shaped elongated members connected at sides of said H-shaped elongated members by integrally formed substantially rigid links;

additional wall panels having bottom edges inserted into top portions of said plurality of H-shaped elongated members; and upper edges of said additional wall panels inserted into top cap members comprising inverted substantially U-shaped elongated structures extending along substantially the entire length of said wall panels, said top cap members being connected by integral substantially rigid links disposed along substantially the entire length of said top cap member, said integral links being dimensioned and disposed to block only a small portion of space between said top cap members, thereby allowing large volumes of liquid building material to be poured between said top cap members, said top cap members being dimensioned to fit over said wall panels with sufficient clearance to pivot and slide thereover substantially along a longitudinal axis of each said wall panel to provide a level top cap member configuration in spite of unlevel wall panel configurations to form a level wall, said top cap member comprising material capable of being penetrated by a conventional fastener to allow said top cap member to be held in place coupled to said wall panels to retain said level top cap member configuration.

9. The system as defined in claim 8, wherein additional said H-shaped elongated members and said wall panels are stacked to form a wall of desired height.

10. The system as defined in claim 8, wherein said H-shaped elongated members comprise plastic material.

11. The system as defined in claim 8, wherein said H-shaped elongated members comprise extruded plastic material.

12. The system as defined in claim 8, wherein said H-shaped elongated members comprise steel.

13. The system as defined in claim 8, wherein said links prevent compression or expansion of the substantially parallel relationship of said wall panels.

* * * * *